US012661570B1

(12) United States Patent
Baker

(10) Patent No.: US 12,661,570 B1
(45) **Date of Patent: *Jun. 23, 2026**

(54) GLOVE

(71) Applicant: Scott Baker, Sherman Oaks, CA (US)

(72) Inventor: Scott Baker, Sherman Oaks, CA (US)

( * ) Notice: Subject to any disclaimer, the term of this patent is extended or adjusted under 35 U.S.C. 154(b) by 1003 days.

This patent is subject to a terminal disclaimer.

(21) Appl. No.: 17/833,463

(22) Filed: Jun. 6, 2022

Related U.S. Application Data

(63) Continuation-in-part of application No. 15/853,255, filed on Dec. 22, 2017, now Pat. No. 11,865,431.

(51) Int. Cl.
*A63B 71/14* (2006.01)
*A41D 19/015* (2006.01)

(52) U.S. Cl.
CPC ..... *A63B 71/145* (2013.01); *A41D 19/01523* (2013.01); *A41D 19/01582* (2013.01); *A63B 2244/10* (2013.01)

(58) Field of Classification Search
CPC ..... A41D 19/0013; A41D 19/0017; A41D 19/0048; A41D 19/01582; A41D 19/01558; A63B 71/145
See application file for complete search history.

(56) References Cited

U.S. PATENT DOCUMENTS 4,411,024 A * 10/1983 Hayes ..... A63B 71/145 2/161.1
RE32,287 E * 11/1986 Willis ..... A63B 71/148 2/16
4,796,306 A * 1/1989 Mitchell ..... A63B 71/141 2/163
4,984,300 A * 1/1991 Cho ..... A63B 71/145 2/18
5,022,094 A * 6/1991 Hames ..... A41D 19/01547 2/163
5,575,008 A * 11/1996 McBride ..... A41D 19/01523 2/161.1
5,697,103 A * 12/1997 Wiggins ..... A41D 19/0034 2/163
6,013,044 A * 1/2000 Estwanik ..... A41D 19/01582 602/61
6,119,267 A * 9/2000 Pozzi ..... A41D 13/088 2/161.1
6,691,315 B1 * 2/2004 Clarke ..... A63B 71/145 2/18
7,406,720 B1 * 8/2008 Hoelscher ..... A41D 19/01588 2/163
8,646,113 B2 * 2/2014 Clement ..... A41F 1/06 2/161.1
9,079,093 B2 * 7/2015 Clement ..... A63B 71/145
9,380,820 B1 * 7/2016 Griego ..... A63B 21/00
9,545,126 B2 * 1/2017 Bisaillon ..... A41D 19/01523
10,004,975 B2 * 6/2018 Clement ..... A63B 71/145
11,344,788 B1 * 5/2022 Wittman ..... A63B 71/145
11,465,034 B2 * 10/2022 Sharp ..... A41F 1/06
2011/0277205 A1 * 11/2011 Cuadrado ..... A41D 19/01523 2/18

(Continued)

*Primary Examiner* — F Griffin Hall

(57) ABSTRACT

A glove comprising an upper surface, a lower surface, finger sheaths, and a thumb sheath. The glove configured for ease of entry as well as to prevent the finger sheaths from moving into a linear extended position, while allowing the finger sheaths to be in a curved position or a clenched position.

5 Claims, 22 Drawing Sheets

(56) References Cited

U.S. PATENT DOCUMENTS

| | | | | |
|---|---|---|---|---|
| 2013/0000006 | A1* | 1/2013 | Norton | A41F 1/06 2/16 |
| 2013/0198920 | A1* | 8/2013 | Wittman | A41D 13/081 2/16 |
| 2016/0367881 | A1* | 12/2016 | Le | A41F 1/06 |
| 2017/0001097 | A1* | 1/2017 | Ferrer | A41D 19/01523 |

* cited by examiner

FIG. 22
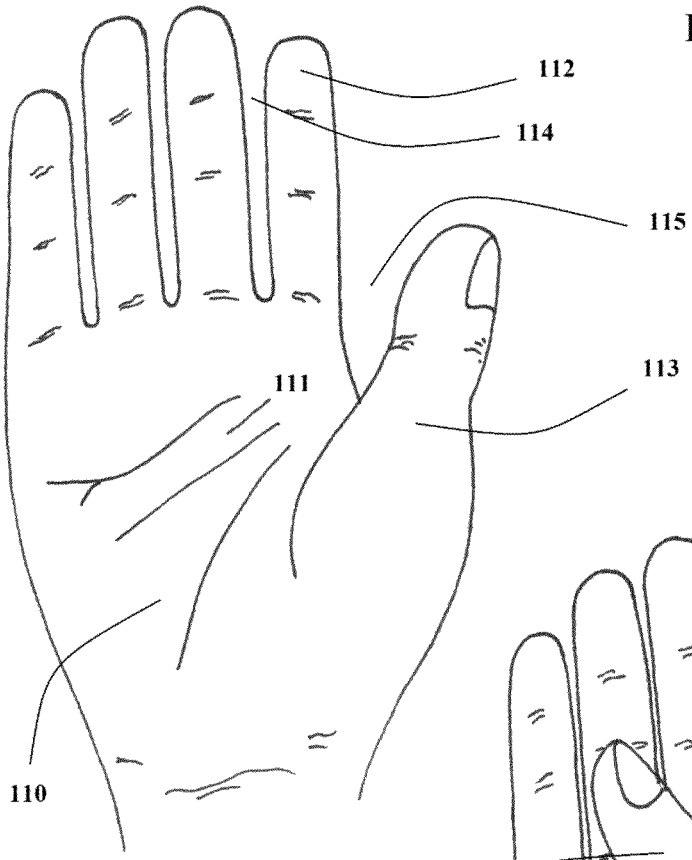
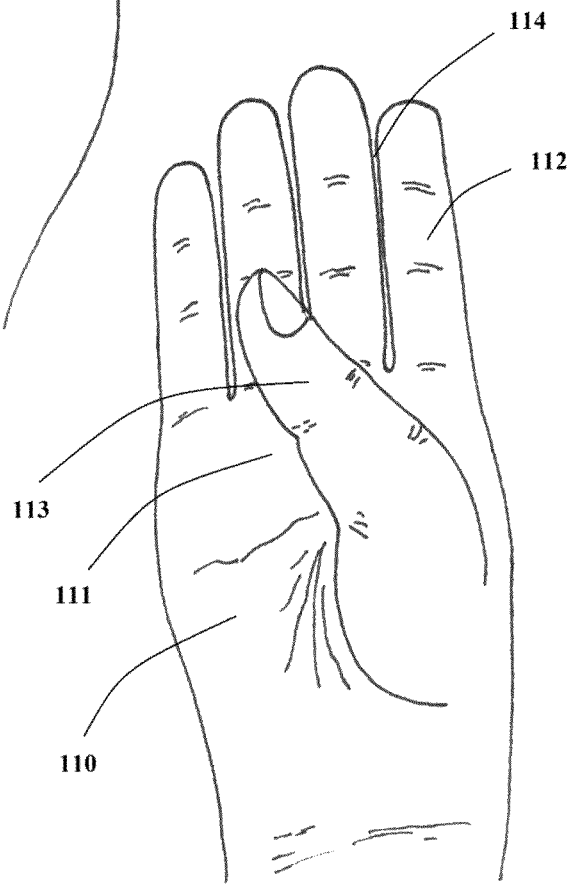
FIG. 23

GLOVE

CROSS-REFERENCE TO RELATED APPLICATIONS

This application claims the benefit of U.S. Non-Provisional patent application Ser. No. 15/853,255 filed Dec. 22, 2017, the contents of which are incorporated.

FIELD AND BACKGROUND OF THE INVENTION

This invention relates to a glove. More particularly, the invention is for a glove which may be used by an athlete, and wherein the glove is constructed so that hand movement within the glove is somewhat limited or restricted. In one form, the glove may be used by a person practicing in the fields of boxing or mixed martial arts (MMA), although the invention is not limited thereto.

Fighting has long been a popular sport. For most of the last 100 years or so boxing has been a dominant force in attracting viewers and thus revenue. As the sport has evolved with stronger athletes, athlete protection has become more and more advanced. The boxing glove of 50 years ago is more like a mitten when compared to the boxing gloves available today. Not only has the outside of the glove changed, but the inside mechanics have also evolved to better protect the fighter's hands.

Over about the last 20 years and certainly in the last 10 years, Mixed Martial Arts (MMA) has become one of the top fighting sports in attracting viewers and revenues from boxing. While the rules have developed significantly as with anything new, the protection for the fighters has been lagging behind in one particular arena.

The very nature of "mixed" martial arts involves a mix comprising predominantly boxing techniques and grappling techniques. Grappling techniques require that a fighter's hands, specifically his fingers, be free from the type of confinement a boxing glove incorporates, such that the fighter's fingers are exposed thereby allowing fighters to use the dexterity and mobility of their fingers in order to grab an opponent in a variety of ways in an effort to submit him and win the contest.

One of the safety issues that has long existed in MMA specifically as a result of the "open fingered glove" designs is "eye pokes". An eye poke can occur at any time and with no malicious intent attached to it. When a fighter is moving closer and perhaps starts to throw a punch (with a clenched fist), but suddenly has to adapt to a movement from the opponent by changing that clenched fist into an open palmed block of some sort, the fingertip on an extended or straightened hand can drive directly into the opponent's eye causing at the very minimum discomfort and momentary blurred vision, but also potentially permanent eye damage.

In combat sports, and more specifically mixed martial arts, boxing is mixed with wrestling (grappling). The boxing function requires a clenched fist posture, while the grappling requires a hand to be open and extendable. Therefore, the respective design of gloves worn by such fighters is different, with fingers exposed and free to grab and move in the case of mixed martial arts, and the hands completely encapsulated for a boxing glove. In mixed martial arts, where both boxing and grappling is used, conventional gloves with fingers exposed and free to move may increase the risk of injury, even though unintentional.

There has long been a need for a glove design that offers padding similar to a boxing glove while allowing finger movement to grab, and at the same time restricting the ability for a finger to poke an opponent's eyeball, or other vulnerable body part.

SUMMARY OF THE INVENTION

In one aspect of the invention, there is provided a glove preferably for use in Mixed Martial Arts (MMA) for protecting a fighter's hands while allowing that fighter to use his fingers and also protecting the fighter's opponents from an accidental fingertip eye poke or other injury.

A glove in accordance with the present invention limits the uses hand to positions: the clenched fist position, and the "at rest" position, in which the hand cannot achieve a fully extended position.

Current MMA gloves are produced in a few sizes which by that very nature do not afford a tight fit surrounding the fingers themselves. In fact, many glove designs have a pliable material utilized for the sides of the fingers while the top and bottom portions of the gloves are typically a stronger material such as leather. MMA gloves allow for the thumb to be fully or partially exposed and the fingers to have one or two knuckles per finger exposed. The pliable material on the sides of gloves allows for even more movement of the finger inside the actual finger area of the glove.

The built-in mobility combined with the added movement due to the material choice in a conventional glove allows for a fighter's fingers to be straightened out completely and risk the occurrence of an eye poke to an opponent.

The current invention is directed toward resolving this safety issue while offering a better fit and better flexibility for the fighter.

When a person's hands are in a naturally relaxed state, there is a curve to the hand. The palm is cupped and the fingers are arched. This is the position to which the present invention restricts the user's hand in relation to the ability to further open or straighten the hand. Conversely, the glove of the invention does not restrict the user's hands from closing completely and unimpeded. Further, it should be noted that the materials used in the current invention are of a type that offers an expandable characteristic that allows for a more secure hand fitting while restricting additional free movement as found in current designs now available.

By restricting the user's ability to extend and straighten the fingers, the potential for an unintended eye poke, or other injury which may be caused to an opponent by an extended finger, is quite notably limited as the natural arch of the hand and fingers is not programmed or specifically adapted for making contact in any manner or fashion. An open hand and straight fingers are more commonplace for slapping, as a clenched fist is for punching. With the open hand position no longer an option due to the movement limitations imposed by the glove of the invention, a user throwing his hand randomly at their opponent and causing eye damage will stop occurring or be significantly diminished.

Additionally, the design of the present invention also utilizes connective materials to limit the amount of independent movement between individual fingers. This design feature will limit the potential for finger joint injuries in users.

BRIEF DESCRIPTION OF THE DRAWINGS

FIG. 22 of the drawings shows the palm side of a hand in an open position.

FIG. 23 of the drawings show the palm side of a hand with the fingers closer together and the thumb moved across the palm.

DETAILED DESCRIPTION OF THE DRAWINGS

The invention will now be described in further detail with reference to the accompanying drawings. The various drawings in this application show different embodiments of a glove in accordance with the invention, all of which possess the ability to configure the hands, and restrict certain movements thereof, by an athlete especially one engaged in the sport of mixed martial arts (MMVA). An important objective of the invention is to provide a glove which limits or restricts the use of hand movement to prevent the fingers extending in a generally linear manner, and attempts to keep the fingers in a curved or arcuate condition in order to protect an opponent from certain injuries, such as an eye poke. The glove of the invention will also allow the user to adopt a clenched fist position.

Figure 1:
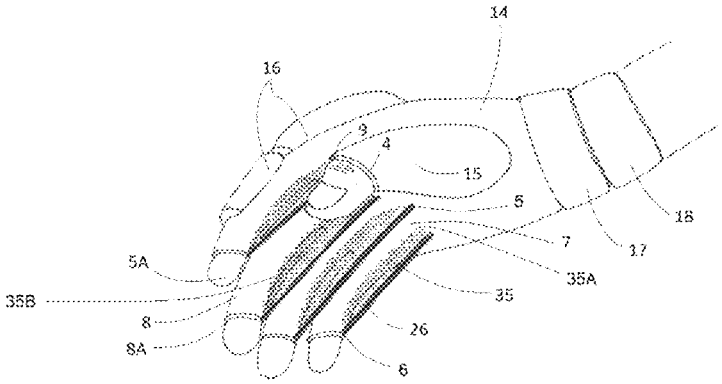
FIG. 1 shows a further perspective view of a glove in bottom h view.

FIG. 1 shows a perspective view of the glove 14 in this embodiment. One end of the cording 26 is attached to the finger sheath on the bottom of the finger sheath at the finger tip 6, the other end of the cording 26 attaches to the lower palm surface 5. Webbing 35 is attached between the cording 26 and the palm surface material contact area 35A/finger sheath material contact area 35B. Knuckle padding 16 and retaining straps 17/18 are also detailed.

Figure 2:
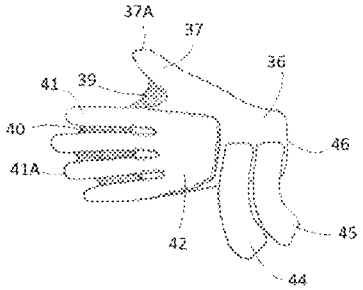
FIG. 2 shows a palm up view of a glove illustrating a second embodiment of the present invention.
Figure 4:
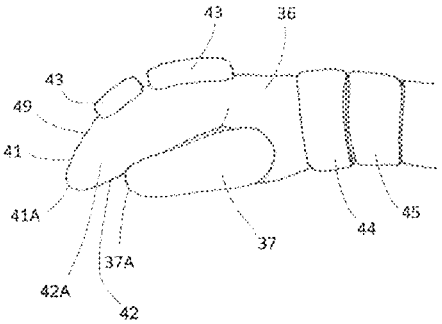
FIG. 4 shows a hand in a glove illustrated in FIG. 2 with the fingers in a relaxed position.
Figure 3:
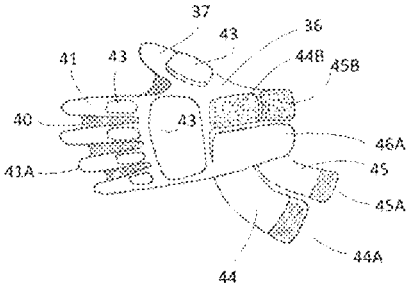
FIG. 3 is a palm down view of the glove shown in FIG. 2.
Figure 5:
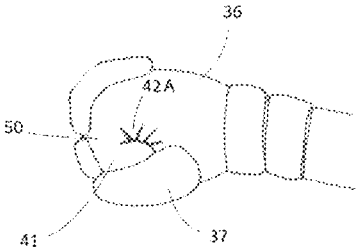
FIG. 5 shows a hand in a glove illustrated in FIG. 2, with the fingers in the clenched position.

FIGS. 2-5 show a further embodiment of a glove 36 in accordance with the invention. FIG. 2 is a palm up view, FIG. 3 is a palm down view, FIG. 4 is a side view with the hand in the natural resting position, and FIG. 5 is a further side view with the hand in a clenched position.

There is provided a thumb sheath 37 with a thumb sheath tip 37A, constituting a closed end. Webbing 39 restricts movement from thumb sheath to finger sheath, while webbing 40 restricts movement from finger sheath 41 to finger sheath 41. The finger sheath 41 with a sheath tip 41A constituting closed ends. The glove 36 further comprises a restrictive palm surface material 42, an upper fastening strap 44, a lower fastening strap 45, and an opening 46 through which the hand is placed into the glove 36. Further, some of these views show the knuckle padding 43. Upper fastening securement material 44A attaches to securement material 44B, and securement material 45A attaches to securement material 45B. An opening 46A provides a hand additional entry flap. Further, there is a top material 49. In FIG. 22, there is shown the restrictive bottom outer surface material 42, while FIG. 23 of the drawings illustrates the restrictive side outer material 50.

The netting 39 and 40 may be mildly flexible, but still keeps the fingers limited in their ability to move away from each other, helping to keep injuries to a minimum, especially if grabbed by an opponent. Closed finger and thumb sheaths 37A and 41A are provided. The cover material 42 may be utilized to restrict the full extension of the fingers.

As shown in FIG. 4, the palm surface material 42 and wrapping 42A up the sides to the top material has the effect of restricting mobility, but only in the direction of extension, and not in the direction of clenching.

Figure 6:
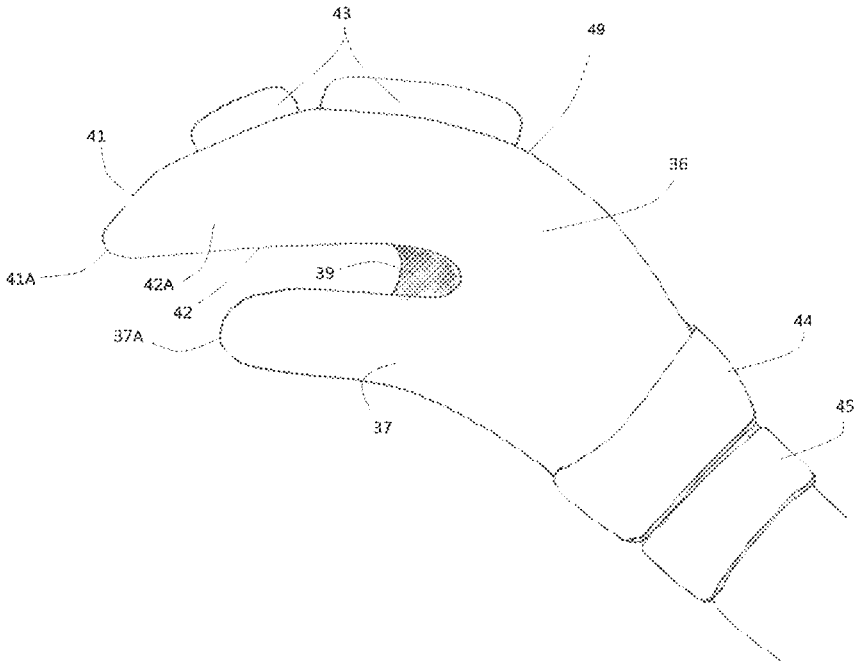
FIG. 6 is a side view of the glove shown in FIG. 4 illustrating the restrictive webbing between the thumb sheath and the index finger sheath.

FIG. 6 is a view similar to that illustrated in FIG. 4 showing the restrictive netting or webbing 39 between the finger sheath and the thumb sheath. An extended palm surface 42 and a back surface 49 are also detailed. This figure shows a hand in the glove when the human hand is in its natural or rest position.

Figure 7:
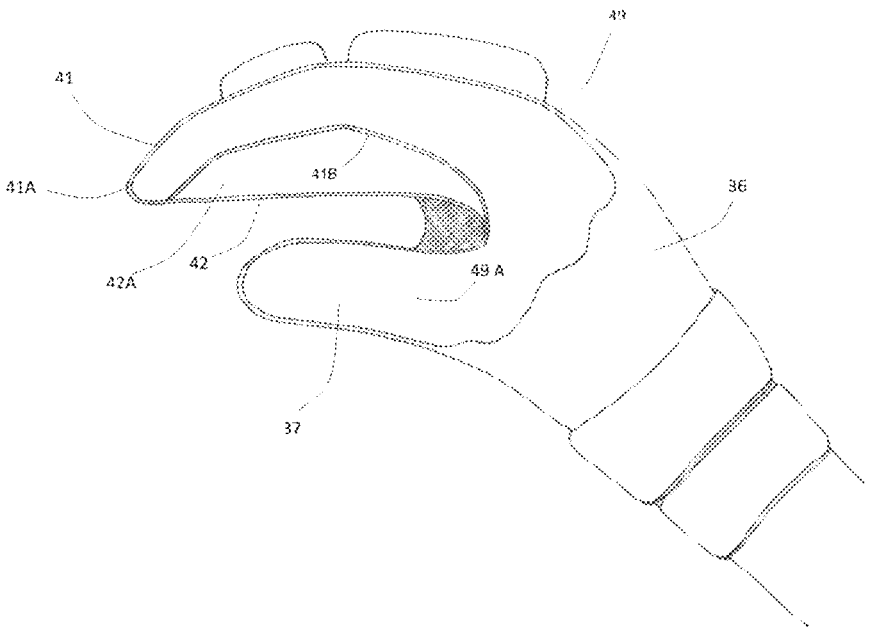
FIG. 7 is a partially cutaway section of the glove shown in FIG. 4 showing an internal finger sheath.

FIG. 7, a cutout 49A is shown to expose the interior space for the hand inside the glove 36. The figure also shows the finger sheath bottom surface 41B which in this embodiment is covered from view by the palm surface material 42. This drawing clearly shows how the ability to straighten the finger sheath is restricted with the extended palm material 42 attaching to the fingertip area 41A of the finger sheath 41. An extended palm surface 42 and a back surface 49 are also detailed.

Figure 8:
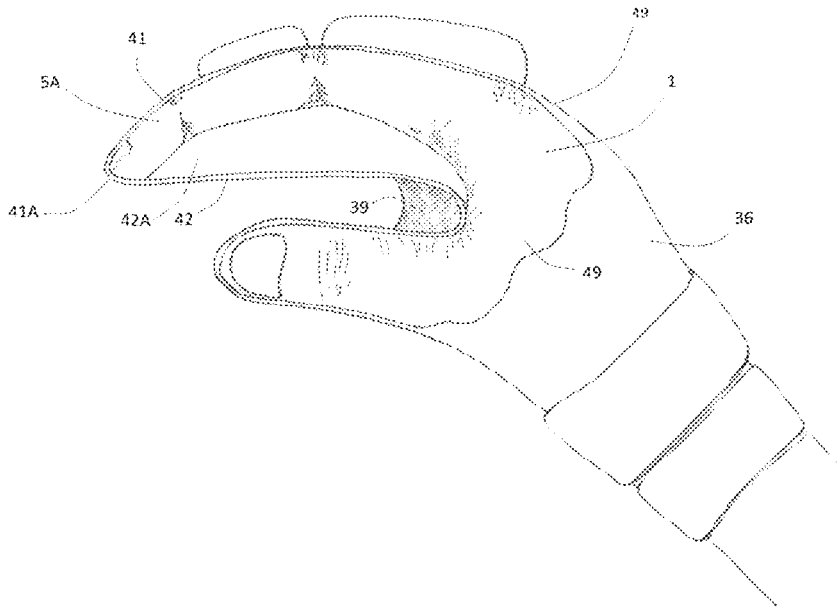
FIG. 8 is a further partially cutaway section of the glove shown in FIG. 4 showing the position of the hand inside the glove.

FIG. 8 shows a different embodiment with a hand 1 inside the glove 36. The finger sheaths having only top surface material and finger tip material, the palm surface material 42, and a space 42A between the finger and the palm surface material. An extended palm surface 42 and a back surface 49 are also detailed.

Figure 9:
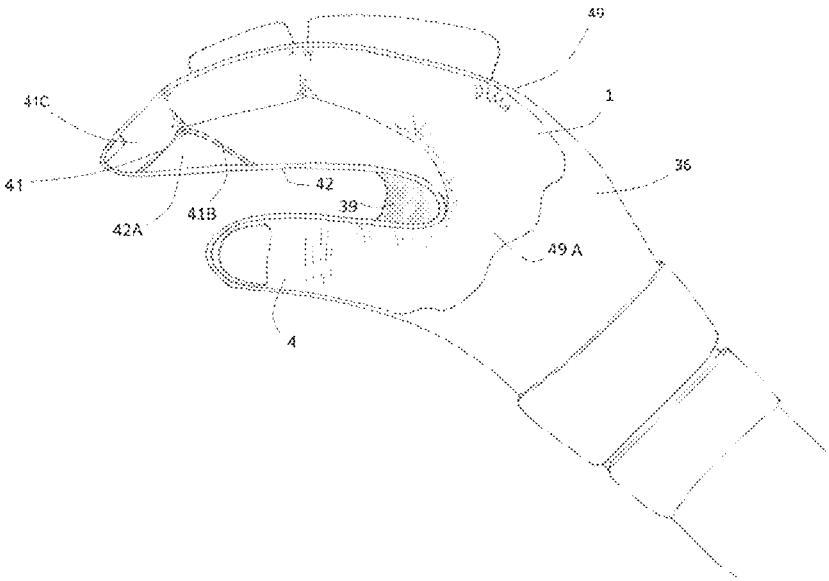
FIG. 9 shows a partially cutaway view of a glove in accordance with a further embodiment of the present invention.

FIG. 9 shows a further embodiment of a glove in accordance with the invention, addressing the issue of potential excess material in the palm area when the hand is in the clenched fist position. A finger sheath bottom material 41 is shortened in length to reduce additional material from the palm area when the glove is clenched. The internal view shows a small ramp 41B of bottom finger sheath material to guide the fingertip into the inner sheath finger tip pocket 41C which is the only part of the finger sheath that encircles the finger. The finger sheath bottom material 41B is attached to the palm surface material 42 in a way which creates a ramp guiding the finger into the finger tip pocket 41C. The area represented by reference numeral 42A, which is an internal non-usable area. An extended palm surface 42 and a back surface 49 are also detailed.

FIGS. 10-14 of the drawings show a further embodiment of the invention.

Figure 10:
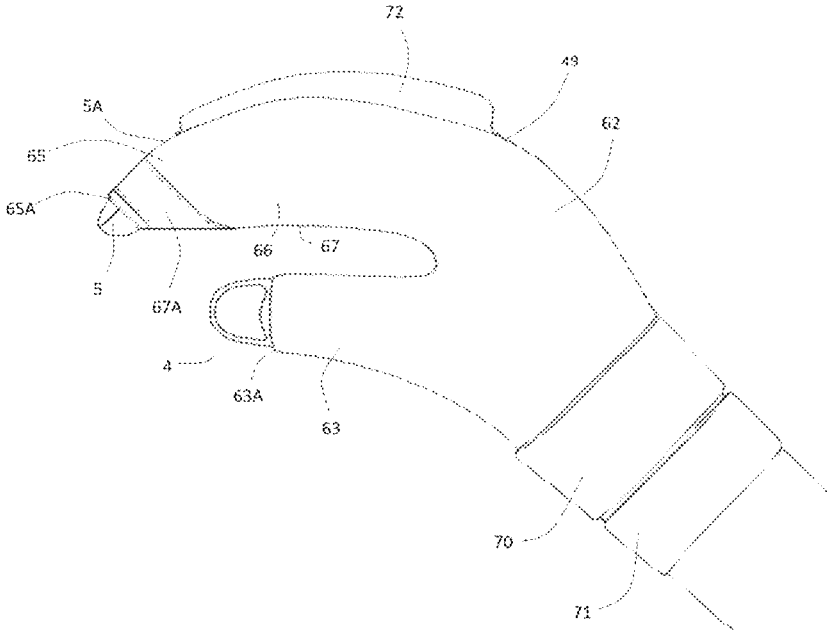
FIG. 10 is a side view of a glove in accordance with a further embodiment of the invention.

FIG. 10 shows an extended length palm surface material 67, having siding material 66 which fills the gap between the finger sheath bottom surface and the extended length palm surface. A wrapping material 67A of the palm material 67 is wrapped out and around the end of the finger sheath side and top material, allowing for the size of the fingertip of the sheath to be adjusted while remaining open, the palm material 67 confines the finger sheath to an arc similar to that of a hand at rest as the palm material also restricts the finger sheath from straightening.

Further, an upper fastening strap 70, a lower fastening strap 71, as well as knuckle padding are provided for the glove 62. A back surface 49 is also detailed.

Figure 11:
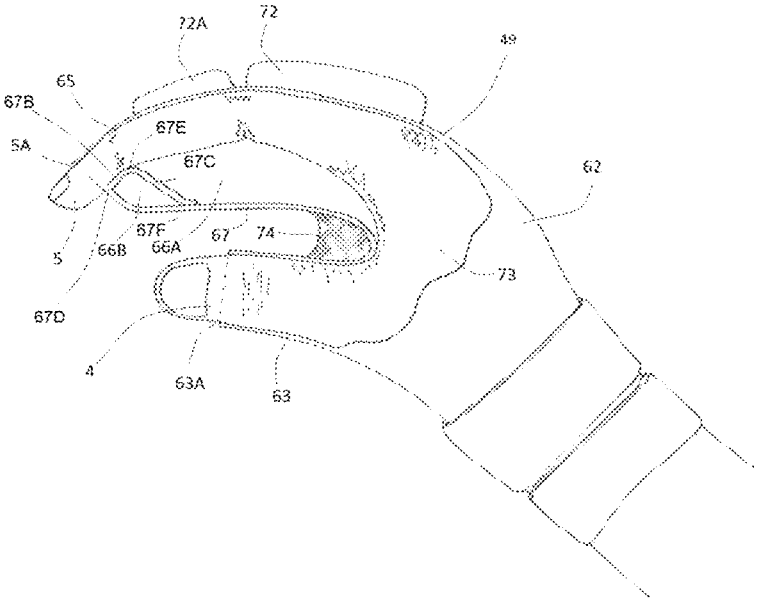
FIG. 11 shows a view of the glove illustrated in FIG. 10, partially cutaway to show a hand inside of the glove.

FIG. 11 shows a side view of the glove in accordance with this embodiment, with a portion cutaway 73 to illustrate the hand in a natural resting position within the glove 62, including the thumb and finger tips extending through the finger and thumb sheath openings. This figure also illustrates the finger sheath internal open space 66A, the finger sheath internal ramp area 66B, (which is non-usable space), and the extended palm surface material 67. The finger sheath having a top surface 65, a fingertip portion 5A, and a partial bottom surface 67B, the fingertip portion 5A attached to the end of the extended palm surface 67 at connection point 67D, the partial bottom surface 67B of the finger sheath having a bend starting at the joint between the distal and middle phalanges 67E of a users finger and at an angle between 45 degrees and 90 degrees away from the finger towards and connecting to the inside of the extended palm surface at connecting point 67F, creating a ramp 67C configured to guide a finger tip of a user into the only portion of the finger sheath that completely encircles the finger of the user. Knuckle padding 72 and 72A are provided, and the cutout 73 helps to illustrate the position and fit of the hand within the glove 62.

Figure 12:
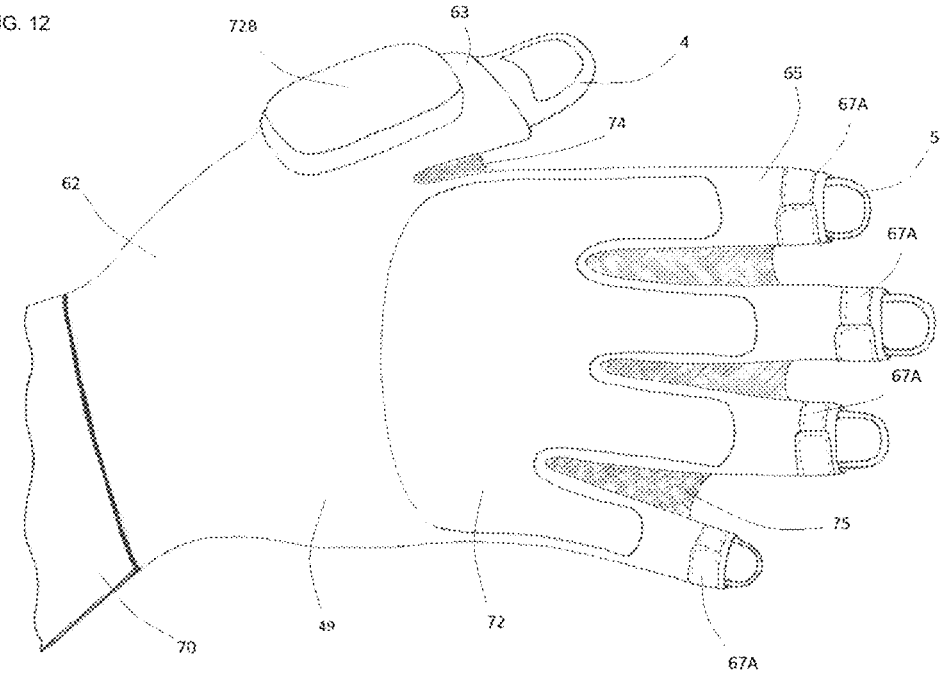
FIG. 12 illustrates a palm down view of the glove shown in FIG. 10 showing palm material wraps around the finger ends.

FIG. 12 shows a palm down view of an embodiment of the invention including a detail showing the palm surface wrapping material 67A wrapping around the ends of the finger sheaths 65 in order to adjust the size of the fingertip opening. A restrictive webbing 74 is provided between the finger sheath and the thumb sheath. Further, restrictive webbing 75 is shown between adjacent fingers sheaths.

Figure 13:
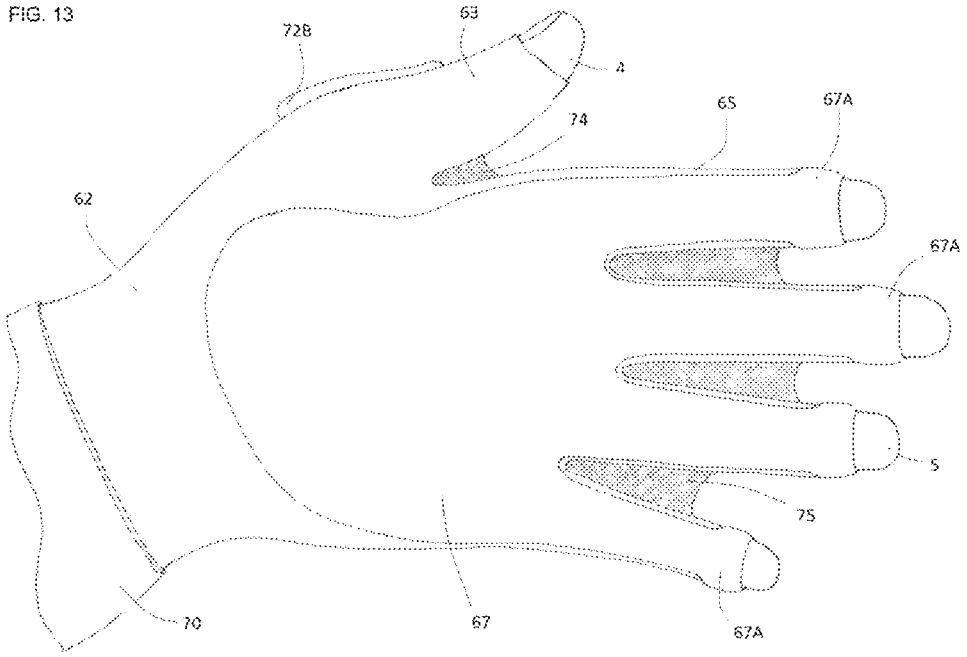
FIG. 13 illustrates a palm up view of the glove shown in FIG. 12 detailing the palm material.

FIG. 13 shows a palm up view of the glove 62, illustrating the palm surface material 67 and the palm surface wrapping material 67A wrapping around the finger ends of the finger sheaths 65 along with the webbing 74 and 75.

Figure 14:
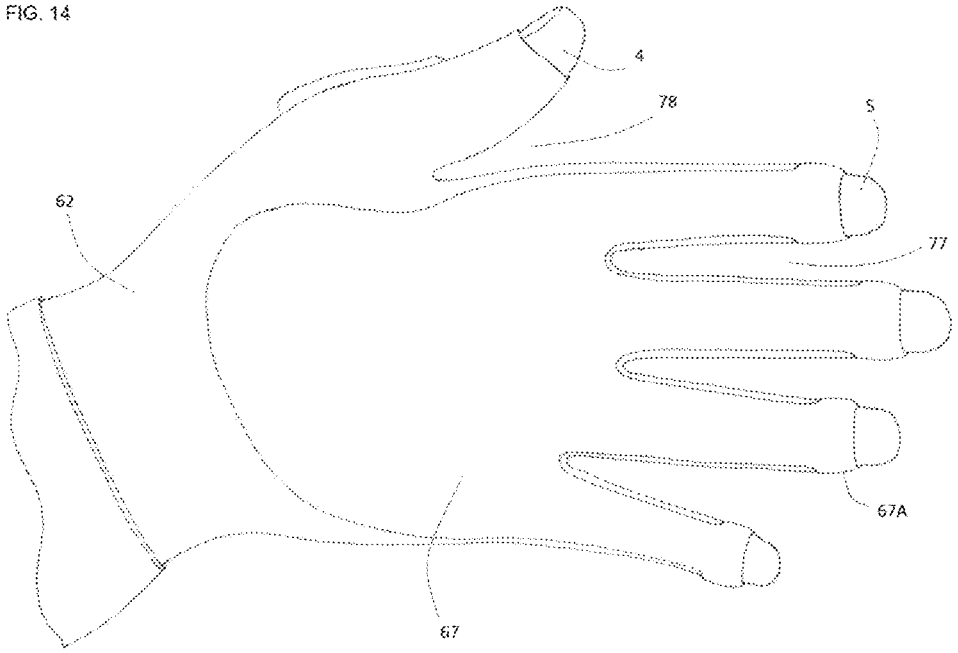
FIG. 14 illustrates a view similar to that shown in FIG. 13 without netting or webbing between sheaths.

FIG. 14 is a similar view to that shown in FIG. 13, without the netting or webbing between the sheaths detailed in FIG. 13. This is apparent from the unrestricted spaces 77 and 78 between the fingers sheaths and between the finger sheath and thumb sheath respectively.

FIGS. 15-18 show yet a further embodiment of the present invention. In this embodiment, a system is provided whereby the amount of restriction in the extension of the finger sheath is adjustable by the user. This may be useful in the professional fighting arena where consistency for fairness is essential. The adjustability of the glove in this embodiment ensure that each competitor's finger extension restriction amount is the same. These figures are similar to those shown in the previous embodiment, with the exception that the netting or webbing has been removed.

Figure 15:
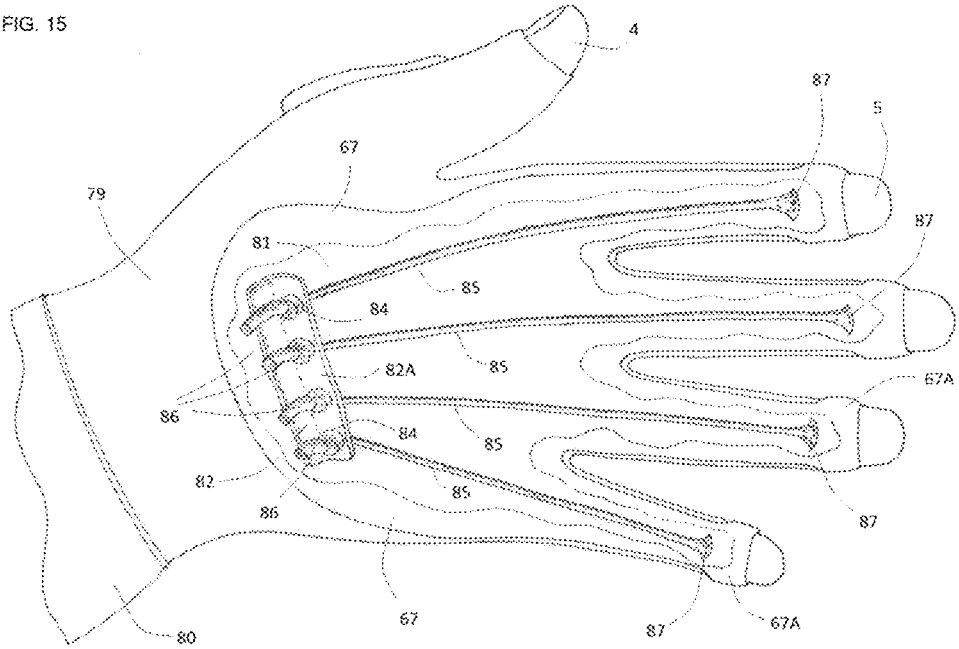
FIG. 15 illustrates a further embodiment of a glove in accordance with the present invention including cording.

FIG. 15 The glove 79 in this embodiment includes an upper fastening strap 80, an inner palm surface 81, and a folded cord mounting tab 82. A cord mounting tab upper flap 82A with mounting holes 84 is provided for adjusting the cording 85. Each cord 85 once passed through the mounting hole 84 terminates with a cording knot 86. At the opposite end of the cording 85, the cording 85 has flattened and sewn cording ends 87. It will be appreciated that utilizing knots to adjust finger sheath restriction is just one way of effecting adjustment.

Figure 16:
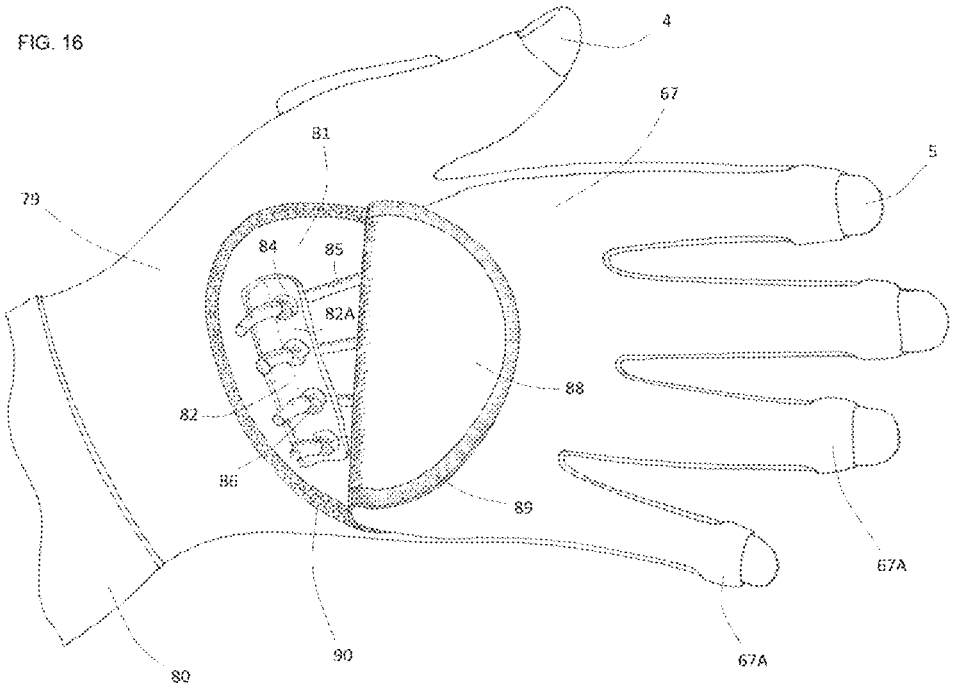
FIG. 16 illustrates a glove as shown in FIG. 15 showing an access flap in an open position to provide access to the adjustable cording.

FIG. 16 Showing the extended length palm surface access flap 88 portion of the outer palm surface 67 which provides access for adjusting the internal restriction system, the user can see the cord mounting tab 82 comprised of a pliable but strong material that allows the cording to be adjusted for restricting the arc of the finger sheaths. A knot is tied to attain the desired level of restriction by appropriately manipulating the length of the cording 85. The extended length palm surface access flap 88 may be held closed by a Velcro material or by some other fastening or connecting mechanism. The attachment material 89 on the extended length palm surface access flap 88 corresponds with the attachment material 90 on the glove 79, which together may be of Velcro, and operate to keep the extended length palm surface access flap 88 closed when no access is required.

Figure 17:
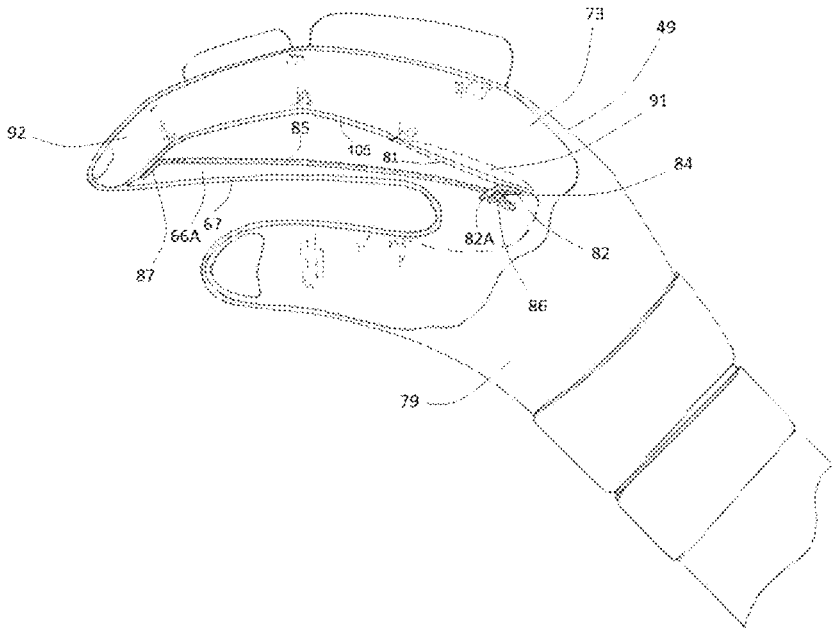
FIG. 17 illustrates a partially cutaway section of the glove illustrated in FIG. 16 including cord mounting tabs and cording.

FIG. 17 shows a partial cutaway 73 side view including an additional deeper level cutout 91 which provides a view through the skin of the hand that is between the thumb and index finger. It can be seen in this figure how the cord mounting tab 82 attaches to the inner palm surface 81 under the extended length palm surface access flap 88. The natural resting position of the finger, as shown by reference numeral 92, is illustrated, and this figure clearly shows the effect of the cording 85 in restricting the user from straightening or extending the fingers. A back surface 49 is also detailed.

Figure 18:
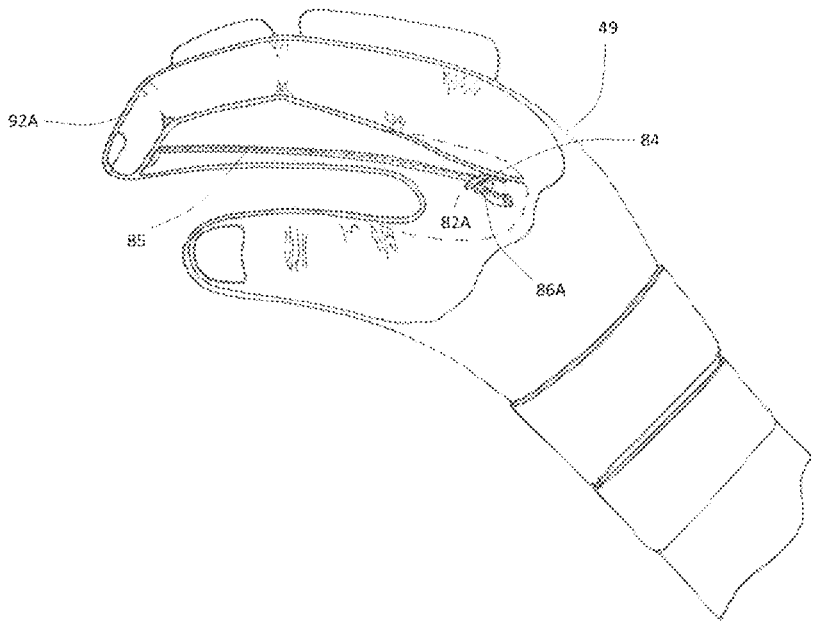
FIG. 18 illustrates a partially cutaway section of a glove similar to that illustrated in FIG. 17 illustrating a different length of the tail of the knot and showing a more severe angle to the finger and sheath itself.

FIG. 18 shows a view similar to that in FIG. 17. A cording knot tail 86A is showing a tale which is longer than shown to be in FIG. 16 because the finger sheath is pulled more tightly making the arc of the finger sheath smaller. Clearly, the tail will be longer when the knot is further up the cording, and vice versa. Reference numeral 92A helps illustrate the angle to which the finger sheath has been restricted by the cording when compared to #92 of FIG. 17, having been pulled shorter and tied in place through the cord mounting tab holes 84 in the cord mounting tab 82.

Figure 19:
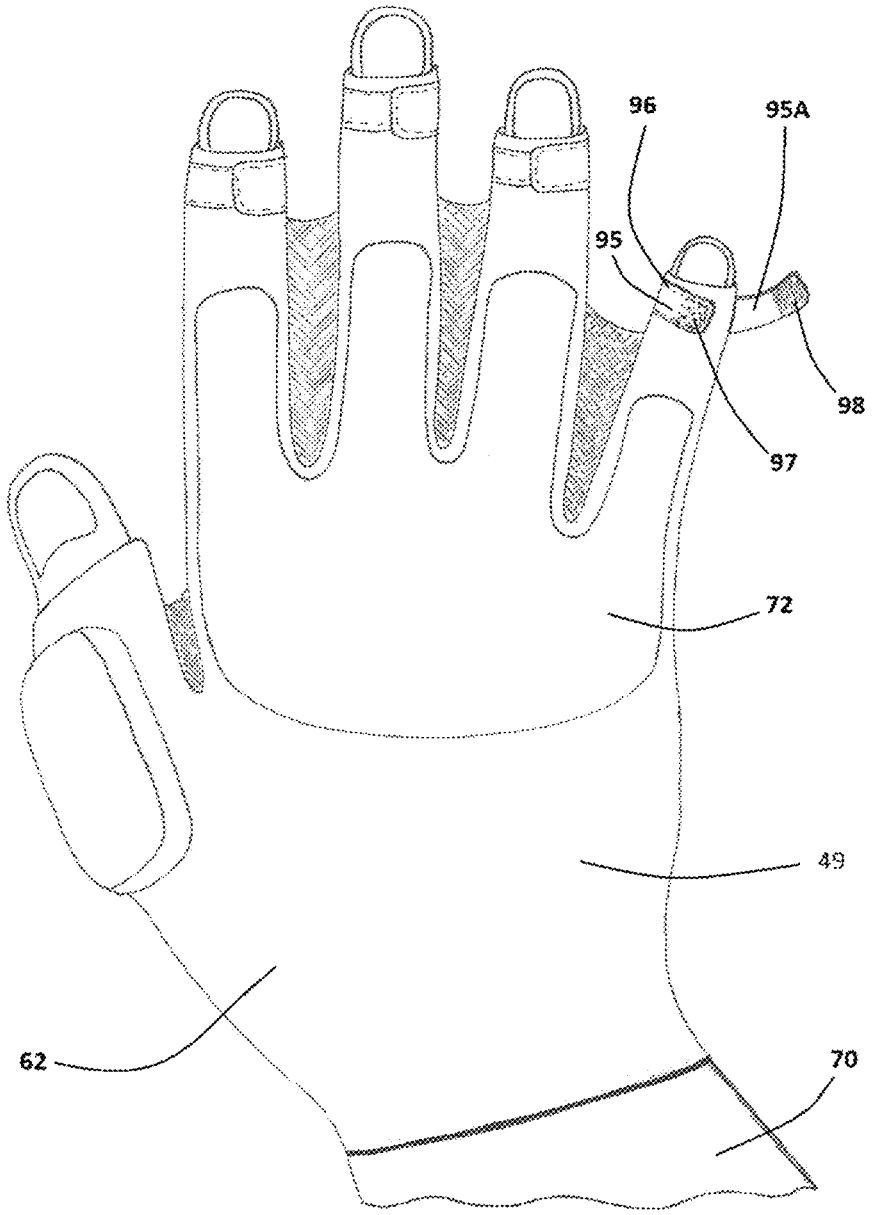
FIG. 19 of the drawings illustrates a glove incorporating an adjustable fingertip control wrapping.
Figure 20:
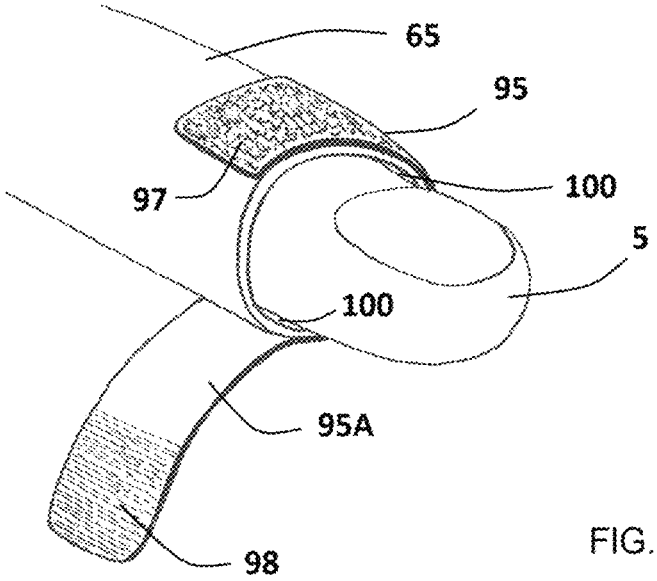
FIG. 20 of the drawings shows a detail of the adjustable finger tip control wrapping in the unfastened condition.
Figure 21:
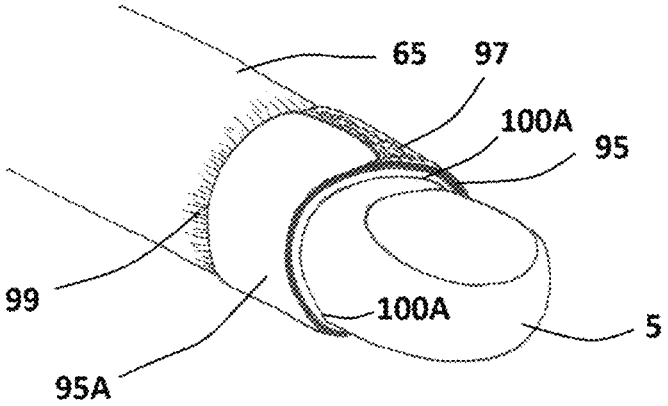
FIG. 21 of the drawings shows a detail of the adjustable fingertip control wrapping in the fastened condition.

FIGS. 19-21 show an embodiment of the invention which incorporates an adjustable fingertip control wrapping. The purpose and function of the control wrappings is to better accommodate fingers which may be thinner or smaller in circumference than the actual finger sheath end opening. By adjusting this wrap after the hand is in the glove, the wearer's finger will be snugly accommodated within the sheath of the glove to facilitate operation of the glove at its maximum design efficiency. A back surface 49 is also detailed.

In FIG. 19, there is shown a glove including an upper fastening strap 70, knuckle padding 72, and an adjustable fingertip control wrapping 95. This is comprised of the secured end of an adjustable fingertip control wrapping 95, and the adjustable end of the adjustable fingertip control wrapping 95A, the position of which can be varied to alter the size at or near the finger opening. The securement end stitching 96 insures an effective fastening to the glove. The fingertip control wrapping includes a fastening strap Velcro material 97 (male side) and the fastening strap contact adhesion material 98 (female side). The adhesion material 98 can be placed on the Velcro material 97 in different ways and locations so that the finger opening remains at its maximum size, or where a part of the finger sheath under the material 97 and 98 will be squeezed slightly to make the finger opening smaller. An appropriate adjustment can be made based on the thinness or circumference of the fingers. This embodiment therefore offers an additional layer of fit, so that the maximum comfort and efficiency of the glove can be utilized.

In FIGS. 20 and 21, a detail of the adjustable fingertip control wrapping is illustrated. FIG. 20 shows the wrapping in the unwrapped condition, while FIG. 21 shows the wrapping in the secured position, adjusted for the circumference of the wearer's finger. These figures illustrate a finger 5 in the finger sheath 65. The secured end of the adjustable fingertip control wrapping 95 is releasably connected to the adjustable end of the adjustable fingertip control wrapping 95A. A fastening strap of Velcro material 97 (male side) thus releasably engages with the fastening strap contact adhesion material 98 (female side). Reference numeral 99 represents the finger sheath squeezed down to a smaller opening to provide a more complete and effective contact fit around the finger 5.

In FIG. 22 showing a hand 110 the palm side 111 of a hand is shown in relaxed position with a substantial space 114 between the fingers 112 and a thumb 113 with a substantial space 115 between the thumb and the closest finger.

In FIG. 23 showing a hand 110 the palm side 111 of a hand is shown in compressed position with a smaller space 114 between the fingers 112 than shown in FIG. 22, and a thumb 113 that is moved across the palm area 111.

Figure 24:
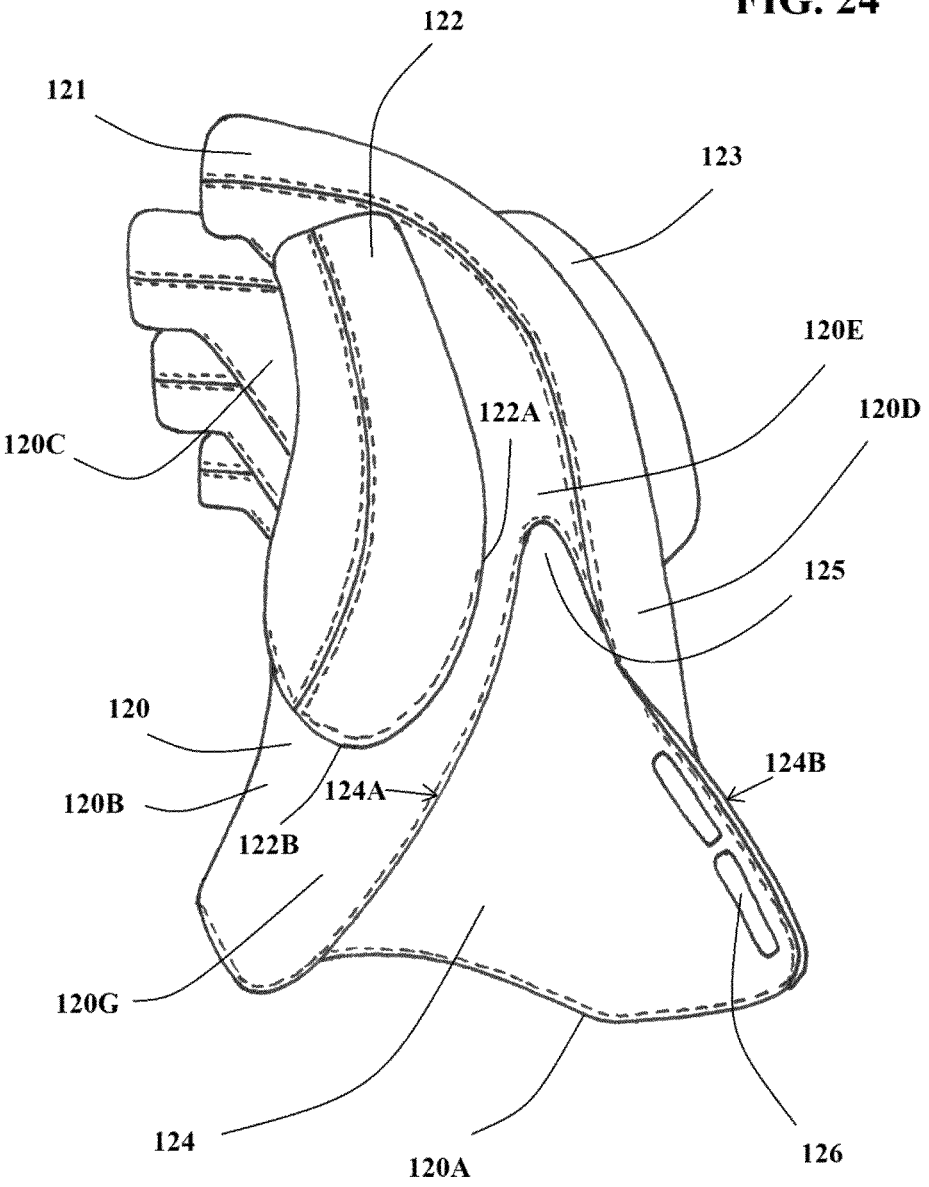
FIG. 24 of the drawings shows a glove from a side angle exposing the expandable access opening area on the side of the glove and positioned on a line between the thumb sheath and the index finger sheath.

In FIG. 24 displaying a glove 120 from a side angle with an entry end 120A, a wrist area 120B, an extended length palm surface 120C, a back surface 120D, a side surface 120E, a plurality of finger sheaths 121, a thumb sheath 122, a thumb sheath connection point 122B, knuckle padding 123, an area that is expandable 124 for greater access into the entry portion 120A, the expandable area 124 extending from the entry end portion 120A traversing along the side of the glove 120E to an end point 125 located close to the thumb sheath index finger sheath convergence point 122A, and a plurality of closure strap through slots 126, the expandable area 124 having a palm surface edge 124A and a back surface edge 124B.

Figure 25:
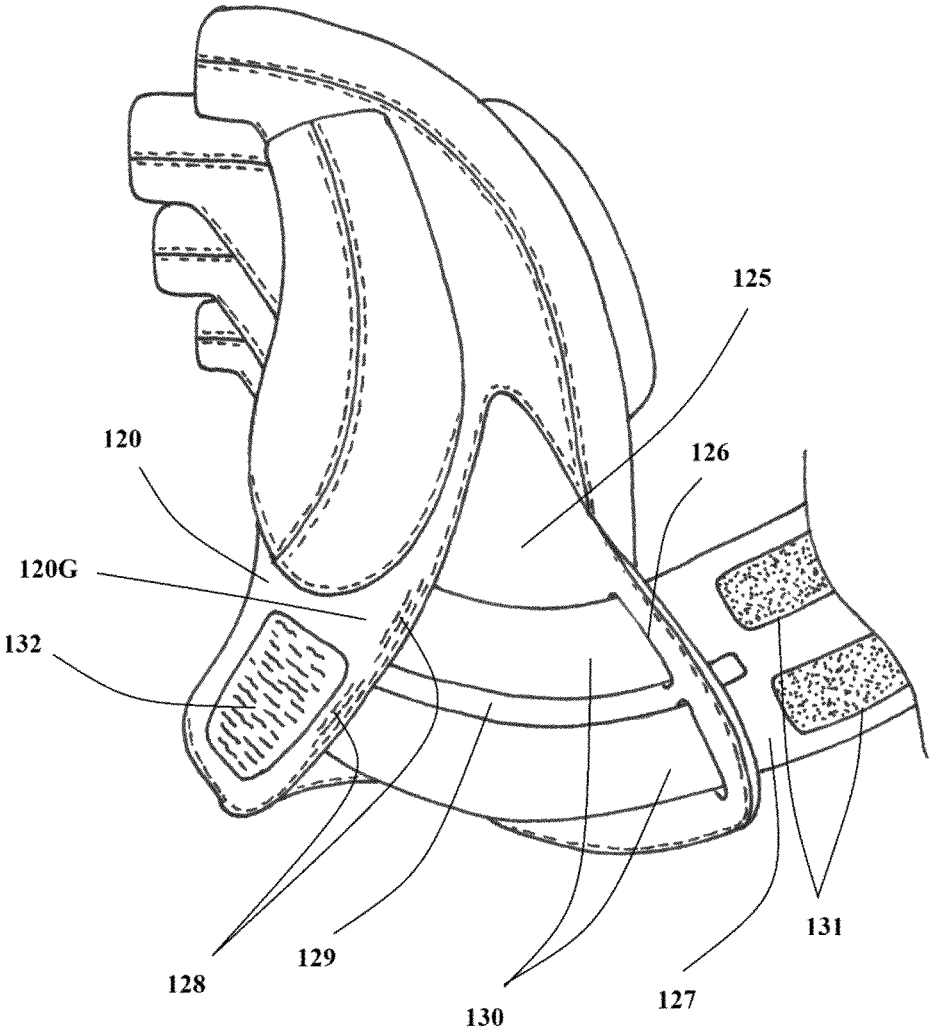
FIG. 25 of the drawings shows a glove from a side angle exposing the expandable access opening area on the side of the glove along with a closure strap.

In FIG. 25 displaying a glove 120 with a closure strap 127 having an attachment end point 128 that is split into a plurality of straps 130 with a separation slot 129 between the plurality of straps 130, the plurality of straps 130 attaching to the wrist side portion 120G at the attachment point 128. The closure strap 127 having male Velcro tabs 131 that releasably secure to female Velcro tabs 132 located on the wrist side area between the thumb sheath and the user entry location.

Figure 26:
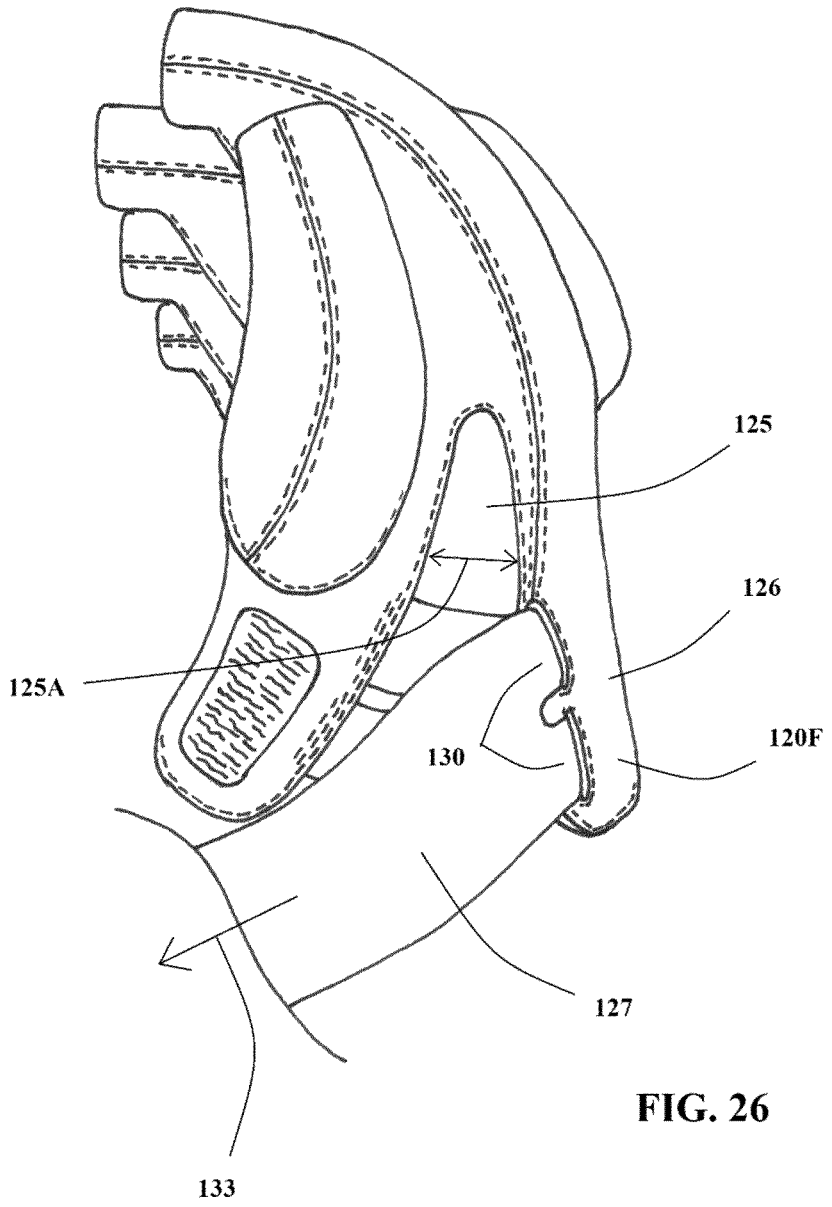
FIG. 26 of the drawings shows a glove from a side angle exposing the expandable access opening area on the side of the glove along with a closure strap positioned to start closing the glove.

In FIG. 26 showing a glove with a closure strap 127 with the split portion of the closure strap wherein a plurality of straps 130 having passed through the closure strap through slots 126 located in the top side wrist portion 120F of the glove 120, the closure strap 127 being pulled across the side opening area 124 in the direction of the arrow 133 which in turn pulls the glove top side wrist portion 120F towards the bottom side wrist portion 120G which in turn closes the side opening area 124 the closure of the side area further indicated by directional arrow 124A. The amount of closure dictated by the size of a user's wrist, once a comfortable fit is achieved the closure strap 127 in wrapped around the wrist portion 120B of the glove 120 aligning closure tabs 131 and 132 to secure said closure.

Figure 27:
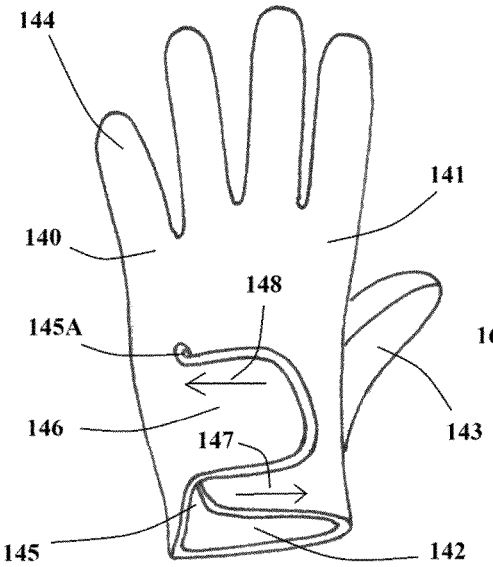
FIG. 27 of the drawings shows the back side of a fashion glove with the expandable access opening area and closure strap on the backside (or top) of the glove.

In FIG. 27 showing a fashion glove 140 having a back surface 141, an opening/entry point 142, a thumb sheath 143, a plurality of finger sheaths 144, an enlargable area 145 to further facilitate entry into the glove which opens beyond the mounting point of the thumb sheath closest to the opening/entry point 142 as indicated by 145A, an adjustment strap 146, directional arrow 148 indicating the direction the closure strap 146 is moved to open the glove and directional arrow 147 indicating the direction the back surface of the glove 141 is moved to further open the glove for entry.

Figure 28:
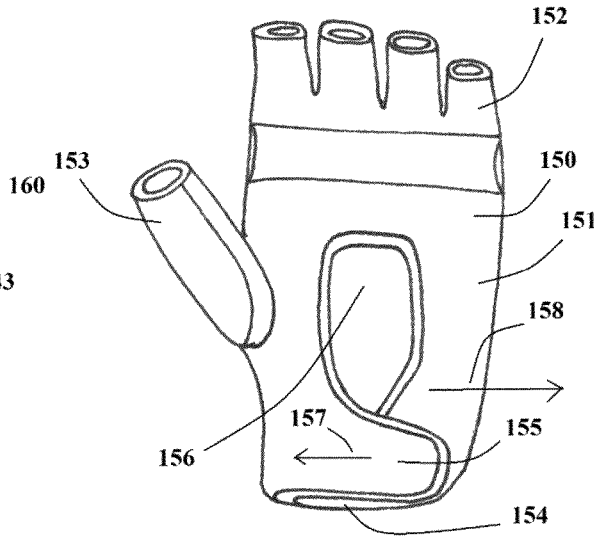
FIG. 28 of the drawings shows the palm side of a fighting glove with the expandable access opening area and closure strap on the palm side of the glove.

In FIG. 28 showing a fighting glove 150 with a palm portion 151, a plurality of finger sheaths 152, a thumb sheath 153, an opening/entry section 154, a closure strap 155, an open area in the palm portion 156, an arrow 157 showing the direction the adjustment strap 155 is moved to open the glove further while arrow 158 shows the direction the palm portion moves to allow for a user to enter the glove.

Figure 29:
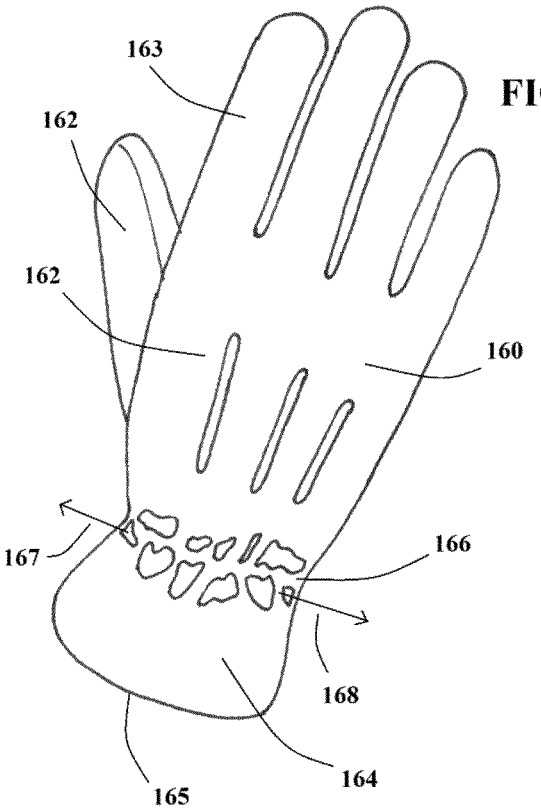
FIG. 29 of the drawings shows the back side of a winter glove with the wrist area being an elastic banded expandable access area.

In FIG. 29 showing a winter glove 160 with a back surface 161, a thumb sheath 162, a plurality of finger sheaths 163, a wrist portion 164, an opening/entry point 165, an internal expandable area 166, directional arrows 167 and 168 detailing the direction the expandable area moves when a user enters the glove.

Figure 30:
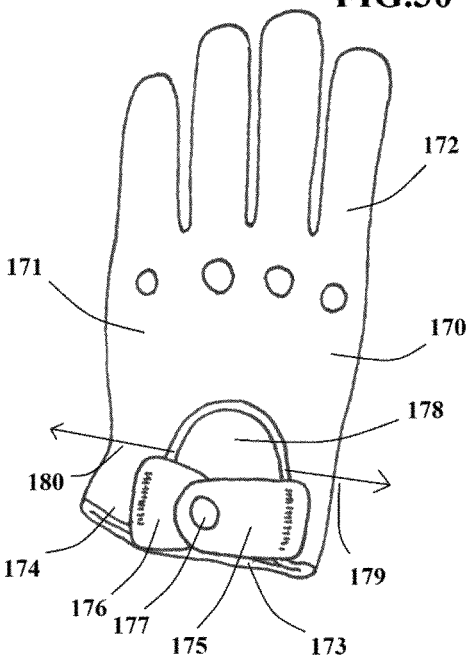
FIG. 30 of the drawings shows the back side of a driving glove with the expandable access opening area and closure strap on the back side of the glove.

In FIG. 30 showing a driving glove 170, with a back surface 171, a plurality of finger sheaths 172, an opening/entry point 173, a wrist portion 174, adjustment straps 175 and 176, adjustment straps securement button 177, back surface open area 178, arrow 179 and 180 detailing the direction the back surface moves at the back surface open area 178 to further accommodate entry of the glove by a user.

It will be appreciated, that the present invention as described herein in its various embodiments can take a significant number of different versions and forms. Central to all of the embodiments is the provision of a glove which contains structure for restricting the movement of the hand or fingers when inside the glove. The glove of the invention will make it easier for the user to enter the glove without contracting the hand to squeeze in through the conventionally small wrist entry point of gloves while providing a comfortable environment for the user's hand to be in a natural slightly curved position, as well as in a clenched or fisted position, but not a position in which the user's fingers are straight, extended or linear, in a flat position. As mentioned above, when the fingers are straight or extended, this increases the probability of injury to both the opponent as well as the user of the glove.

The invention claimed is:

1. A glove comprising:

an entry;

a back surface having an entry end and a finger sheath connection end;

an extended length palm surface having an entry end, and a finger sheath connection end;

a plurality of finger sheaths each having a top surface with a connection end, a fingertip portion, and a partial bottom surface connected to the fingertip portion;

a thumb sheath having a top surface, a fingertip portion, and a bottom surface;

the back surface and the extended length palm surface being attached and configured to receive a hand of a user through the entry;

the top surface connection end of each finger sheath of the plurality of finger sheaths is attached to the finger sheath connection end of the back surface, the partial bottom surface of each finger sheath of the plurality of finger sheaths which connects to the fingertip portion of the respective finger sheath is shorter in length than a length of the top surface of the respective finger sheath;

each finger sheath of the plurality of finger sheaths is bent into an arc, the fingertip portion of the respective finger sheath is attached to the finger sheath connection end of the extended palm length surface thereby creating a permanent arc in the respective finger sheath and removing the ability for the finger sheath to be extended or straightened beyond the permanent arc, when worn;

the bottom surface of each finger sheath of the plurality of finger sheaths being configured to bend where a joint between a distal and a middle phalanges of the user would be located inside the finger sheath when worn, the bend being at an angle between 45 degrees and 90 degrees away from the top surface of the respective finger sheath towards and connecting to the extended palm length surface, thereby creating a ramp configured to guide a fingertip of the user into a portion of the finger sheath that completely encircles the finger of the user, when worn;

the plurality of finger sheaths retaining the ability to grasp items as well as to be fully clenched into a fist position, when worn by the user.

2. The glove of claim 1, further comprising:

an expandable access slit located where the back surface and the extended length palm surface of the glove attach, the expandable access slit starting at the entry and traversing directly from the entry towards a thumb sheath index finger sheath convergence point and ending before the thumb sheath index finger sheath convergence point;

the expandable access slit being configured to facilitate an increase in a size of the entry for easier user access.

3. The glove of claim 2, further comprising:

an adjustable securement strap having an attachment end, a releasably secured end, and a hook and loop fastener securement tab at or near an end of the releasably secured end, the adjustable securement strap being configured for tightening the entry around a wrist of the user, when worn;

the adjustable securement strap attachment end being securely attached on the extended length palm surface adjacent a palm surface edge of the expandable access slit;

the releasably secured end of the adjustable securement strap is configured to be placed across the expandable access slit and through a pass-through slot located on the back surface near a back surface edge of the expandable access slit and then be pulled back across the expandable access slit towards the releasably secured end of the adjustable securement strap, thereby reducing the size of the entry;

the hook and loop fastener securement tab on the adjustable securement strap being configured to releasably connect to a corresponding hook and loop fastener securement tab on the extended length palm surface near the palm surface edge of expandable access slit, thereby tightening the glove on the user.

4. The glove of claim 3, further comprising:

the plurality of finger sheaths and the thumb sheath each being open at respective fingertip ends and a thumb tip end, thereby allowing fingertips and a thumb tip of the user to extend beyond the plurality of finger sheaths and the thumb sheath, respectively.

5. A glove comprising:

an entry;

a back surface;

an extended length palm surface;

a plurality of finger sheaths;

a thumb sheath;

an expandable access slit; and an adjustable securement strap;

the back surface having an entry end and a finger sheath connection end, the extended length palm surface having an entry end, and a finger sheath connection end, the back surface and the extended length palm surface being attached and configured to receive a hand of a user through the entry;

each finger sheath of the plurality of finger sheaths having a top surface with a connection end, a fingertip portion, and a partial bottom surface connected to the fingertip portion, the connection end of the top surface is attached to the back surface finger sheath connection end, the partial bottom surface of each finger sheath which connects to the fingertip portion of the respective finger sheath is shorter in length than a length of the top surface of the respective finger sheath;

each finger sheath of the plurality of finger sheaths being bent into an arc, the fingertip portion of the respective finger sheath being attached to the finger sheath connection end of the extended palm length surface thereby creating a permanent arc in the respective finger sheath and removing the ability for the finger sheath to be extended or straightened beyond the permanent arc, when worn;

the bottom surface of each finger sheath of the plurality of finger sheaths being configured to bend where a joint between a distal and a middle phalanges of the user would be located inside the finger sheath when worn, the bend being at an angle between 45 degrees and 90 degrees away from the top surface of the respective finger sheath towards and connecting to the extended palm length surface, thereby creating a ramp configured to guide a fingertip of the user into a portion of the finger sheath that completely encircles the finger of the user, when worn;

the thumb sheath having a top surface, a fingertip portion, and a bottom surface, the expandable access slit located where the back surface and the extended length palm surface of the glove attach, the expandable access slit starting at the entry and traversing directly from the entry towards a thumb sheath index finger sheath convergence point and ending before the thumb sheath index finger sheath convergence point;

the adjustable securement strap having an attachment end, a releasably secured end, and a hook and loop fastener securement tab at or near an end of the releasably secured end of the adjustable securement strap;

the adjustable securement strap being configured for tightening the entry around a wrist of the user;

the adjustable securement strap attachment end is securely attached on the extended length palm surface near a palm surface edge of the expandable access slit;

the releasably secured end of the adjustable securement strap is configured to be placed across the expandable access slit and through a pass-through slot located on the back surface near a back surface edge of the expandable access slit and then be pulled back across the expandable access slit towards the releasably secured end of the adjustable securement strap, thereby reducing a size of the entry;

the hook and loop fastener securement tab on the adjustable securement strap being configured to releasably connect to a corresponding hook and loop fastener securement tab on the extended length palm surface near the palm surface edge of expandable access slit, tightening the glove on the user.

* * * * *